US008882451B2

(12) United States Patent
Fitton et al.

(10) Patent No.: US 8,882,451 B2
(45) Date of Patent: Nov. 11, 2014

(54) FAN

(75) Inventors: Nicholas Gerald Fitton, Malmesbury (GB); Kevin John Simmonds, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 681 days.

(21) Appl. No.: 13/052,846

(22) Filed: Mar. 21, 2011

(65) Prior Publication Data

US 2011/0236219 A1 Sep. 29, 2011

(30) Foreign Application Priority Data

Mar. 23, 2010 (GB) ..... 1004814.8

(51) Int. Cl.

| | |
|---|---|
| ***F04D 25/08*** | (2006.01) |
| ***F04D 29/70*** | (2006.01) |
| ***F04D 29/64*** | (2006.01) |
| ***F04D 29/62*** | (2006.01) |

(52) U.S. Cl.

CPC ..... *F04D 25/084* (2013.01); *F04D 29/646* (2013.01); *F04D 29/703* (2013.01); *F04D 29/626* (2013.01)

USPC ..... 415/121.2; 415/220; 415/214.1

(58) Field of Classification Search

USPC ..... 415/121.2, 90, 208.2, 211.2, 220, 223

See application file for complete search history.

(56) References Cited

U.S. PATENT DOCUMENTS

| | | | | |
|---|---|---|---|---|
| 1,357,261 | A | 11/1920 | Svoboda | |
| 1,767,060 | A | 6/1930 | Ferguson | |
| 1,819,498 | A * | 8/1931 | Cole | 96/133 |
| 1,896,869 | A | 2/1933 | Larsh | |
| 2,014,185 | A | 9/1935 | Martin | |
| 2,035,733 | A | 3/1936 | Wall | |
| D103,476 | S | 3/1937 | Weber | |
| 2,115,883 | A | 5/1938 | Sher | |
| D115,344 | S | 6/1939 | Chapman | |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

Gammack, P. et al., U.S. Office Action mailed Dec. 9, 2010, directed to U.S. Appl. No. 12/203,698; 10 pages.

(Continued)

*Primary Examiner* — Edward Look

*Assistant Examiner* — Wayne A Lambert

(74) *Attorney, Agent, or Firm* — Morrison & Foerster LLP

(57) ABSTRACT

A portable fan includes a casing having an air inlet and a first connector, and an air outlet having a second connector. A filter unit includes a third connector, which is substantially the same as the second connector, for co-operating with the first connector to removably connect the filter unit to the casing, a filter which is located upstream from the air inlet when the filter unit is connected to the casing, and a fourth connector, which is substantially the same as the first connector, for co-operating with the second connector to removably connect the air outlet to the filter unit. This can allow the air outlet to be connected either directly to the casing, or to an optional filter unit which is connected to the casing.

25 Claims, 10 Drawing Sheets

(56) References Cited

U.S. PATENT DOCUMENTS 2,210,458 A 8/1940 Keilholtz
2,258,961 A 10/1941 Saathoff
2,336,295 A 12/1943 Reimuller
2,362,933 A * 11/1944 Schaefer ..... 96/131
2,394,923 A * 2/1946 Little ..... 55/337
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
3,271,936 A * 9/1966 Dauge ..... 55/302
D206,973 S 2/1967 De Lisio
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,850,598 A 11/1974 Boehm
3,871,847 A 3/1975 Fish
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,477,270 A * 10/1984 Tauch ..... 96/140
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,905,340 A 3/1990 Gutschmit
4,978,281 A 12/1990 Conger
5,022,900 A 6/1991 Bar-Yona et al.
5,061,405 A 10/1991 Stanek et al.
5,094,676 A 3/1992 Karbacher
D325,435 S 4/1992 Coup et al.
5,168,722 A 12/1992 Brock
5,176,856 A 1/1993 Takahashi et al.
5,188,508 A 2/1993 Scott et al.
5,266,004 A 11/1993 Tsumurai et al.
5,266,090 A * 11/1993 Burnett ..... 55/333
5,296,769 A 3/1994 Havens et al.
5,310,313 A 5/1994 Chen
5,317,815 A 6/1994 Hwang
5,358,443 A * 10/1994 Mitchell et al. ..... 454/230
5,402,938 A 4/1995 Sweeney
5,407,324 A 4/1995 Starnes, Jr. et al.
5,425,902 A 6/1995 Miller et al.
5,435,817 A * 7/1995 Davis et al. ..... 55/337
5,518,370 A 5/1996 Wang et al.
5,588,985 A 12/1996 Shagott et al.
5,609,473 A 3/1997 Litvin
5,641,343 A * 6/1997 Frey ..... 96/135
5,645,769 A 7/1997 Tamaru et al.
5,649,370 A 7/1997 Russo
5,735,683 A 4/1998 Muschelknautz
5,753,000 A * 5/1998 Chiu et al. ..... 55/357
5,762,034 A 6/1998 Foss
5,762,661 A 6/1998 Kleinberger et al.
5,783,117 A 7/1998 Byassee et al.
D398,983 S 9/1998 Keller et al.
5,837,020 A * 11/1998 Cartellone ..... 55/459.3
5,841,080 A 11/1998 Iida et al.
5,843,344 A 12/1998 Junkel et al.
5,862,037 A 1/1999 Behl
5,868,197 A 2/1999 Potier
5,881,685 A 3/1999 Foss et al.
D415,271 S 10/1999 Feer
5,997,619 A * 12/1999 Knuth et al. ..... 96/224
6,001,145 A 12/1999 Hammes
6,015,274 A 1/2000 Bias et al.
6,053,968 A * 4/2000 Miller ..... 96/224
6,073,881 A 6/2000 Chen
D429,808 S 8/2000 Krauss et al.
6,123,618 A 9/2000 Day
6,155,782 A 12/2000 Hsu
6,156,085 A * 12/2000 Chiu et al. ..... 55/357
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,616,722 B1 * 9/2003 Cartellone ..... 55/459.3
D485,895 S 1/2004 Melwani
6,789,787 B2 9/2004 Stutts
6,830,433 B2 12/2004 Birdsell et al.
6,834,412 B2 * 12/2004 Stanovich et al. ..... 15/327.2
7,059,826 B2 6/2006 Lasko
7,088,913 B1 8/2006 Verhoorn et al.
7,112,232 B2 9/2006 Chang et al.
7,147,336 B1 12/2006 Chou
D539,414 S 3/2007 Russak et al.
7,320,721 B2 * 1/2008 Ham et al. ..... 55/498
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,775,848 B1 8/2010 Auerbach
7,806,388 B2 10/2010 Junkel et al.
8,092,166 B2 1/2012 Nicolas et al.
2002/0106547 A1 8/2002 Sugawara et al.
2003/0059307 A1 3/2003 Moreno et al.
2003/0171093 A1 9/2003 Gumucio Del Pozo
2004/0022631 A1 2/2004 Birdsell et al.
2004/0049842 A1 3/2004 Prehodka
2004/0118093 A1 6/2004 Chang et al.
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.

(56) References Cited

U.S. PATENT DOCUMENTS

| | | | | |
|---|---|---|---|---|
| 2005/0281672 | A1 | 12/2005 | Parker et al. | |
| 2006/0096863 | A1 | 5/2006 | Yamazaki et al. | |
| 2006/0172682 | A1 | 8/2006 | Orr et al. | |
| 2006/0199515 | A1 | 9/2006 | Lasko et al. | |
| 2006/0201119 | A1 | 9/2006 | Song | |
| 2006/0260282 | A1* | 11/2006 | Peng | 55/356 |
| 2007/0035189 | A1 | 2/2007 | Matsumoto | |
| 2007/0041857 | A1 | 2/2007 | Fleig | |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0224044 | A1 | 9/2007 | Hong et al. | |
| 2007/0269323 | A1 | 11/2007 | Zhou et al. | |
| 2008/0020698 | A1 | 1/2008 | Spaggiari | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0314250 | A1 | 12/2008 | Cowie et al. | |
| 2009/0026850 | A1 | 1/2009 | Fu | |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0097953 | A1 | 4/2009 | Brugger et al. | |
| 2009/0188126 | A1 | 7/2009 | Gaillard et al. | |
| 2009/0191054 | A1* | 7/2009 | Winkler | 415/215.1 |
| 2009/0205498 | A1 | 8/2009 | Wang et al. | |
| 2009/0214341 | A1 | 8/2009 | Craig | |
| 2009/0280007 | A1* | 11/2009 | Ou et al. | 415/208.1 |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2011/0058935 | A1 | 3/2011 | Gammack et al. | |
| 2011/0072770 | A1* | 3/2011 | Lakdawala et al. | 55/358 |
| 2011/0110805 | A1 | 5/2011 | Gammack et al. | |
| 2011/0164959 | A1 | 7/2011 | Fitton et al. | |
| 2011/0223014 | A1 | 9/2011 | Crawford et al. | |
| 2011/0223015 | A1 | 9/2011 | Gammack et al. | |
| 2011/0236228 | A1 | 9/2011 | Fitton et al. | |
| 2011/0236229 | A1 | 9/2011 | Fitton et al. | |
| 2012/0031509 | A1 | 2/2012 | Wallace et al. | |
| 2012/0033952 | A1 | 2/2012 | Wallace et al. | |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0114513 | A1 | 5/2012 | Simmonds et al. | |
| 2012/0230658 | A1 | 9/2012 | Fitton et al. | |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 1510354 | 7/2004 |
| CN | 2650005 | 10/2004 |
| CN | 2713643 | 7/2005 |
| CN | 1680727 | 10/2005 |
| CN | 2833197 | 11/2006 |
| CN | 201180678 | 1/2009 |
| CN | 201221477 | 4/2009 |
| CN | 101424278 | 5/2009 |
| CN | 101424279 | 5/2009 |
| CN | 201281416 | 7/2009 |
| CN | 201349269 | 11/2009 |
| CN | 101749288 | 6/2010 |
| CN | 201502549 | 6/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102367813 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| EP | 0 044 494 | 1/1982 |
| EP | 0186581 | 7/1986 |
| EP | 0 556 435 | 8/1993 |
| EP | 1 094 224 | 4/2001 |
| EP | 1 138 954 | 10/2001 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 0/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 240 268 | 7/1991 |
| GB | 2 242 935 | 10/1991 |

(56) References Cited

FOREIGN PATENT DOCUMENTS

| | | |
|---|---|---|
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-60100 | 5/1978 |
| JP | 56-167897 | 12/1981 |
| JP | 57-71000 | 5/1982 |
| JP | 57-157097 | 9/1982 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-52515 | 5/1991 |
| JP | 3-267597 | 11/1991 |
| JP | 3-267598 | 11/1991 |
| JP | 4-43895 | 2/1992 |
| JP | 4-109095 | 4/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 8-21400 | 1/1996 |
| JP | 8-21648 | 1/1996 |
| JP | 9-100800 | 4/1997 |
| JP | 9-287600 | 11/1997 |
| JP | 11-159499 | 6/1999 |
| JP | 11-227866 | 8/1999 |
| JP | 2000-116179 | 4/2000 |
| JP | 2000-201723 | 7/2000 |
| JP | 2001-17358 | 1/2001 |
| JP | 2002-21797 | 1/2002 |
| JP | 2002-138829 | 5/2002 |
| JP | 2002-213388 | 7/2002 |
| JP | 2003-329273 | 11/2003 |
| JP | 2004-8275 | 1/2004 |
| JP | 2004-16466 | 1/2004 |
| JP | 2004-208935 | 7/2004 |
| JP | 2004-216221 | 8/2004 |
| JP | 2004-232954 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2009-62987 | 3/2009 |
| JP | 2010-131259 | 6/2010 |
| KR | 10-2005-0102317 | 10/2005 |
| KR | 2007-0007997 | 1/2007 |
| KR | 10-2010-0055611 | 5/2010 |
| KR | 10-0985378 | 9/2010 |
| TW | M2394383 | 12/2010 |
| TW | M407299 | 7/2011 |
| WO | WO-90/13478 | 11/1990 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO-2005/057091 | 6/2005 |
| WO | WO-2006/008021 | 1/2006 |
| WO | WO-2006/012526 | 2/2006 |
| WO | WO-2006/071503 | 7/2006 |
| WO | WO-2006/083849 | 8/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/010528 | 1/2009 |
| WO | WO-2009/030879 | 3/2009 |
| WO | WO-2009/030881 | 3/2009 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |

OTHER PUBLICATIONS

Gammack, P. et al., U.S. Office Action mailed Jun. 21, 2011, directed to U.S. Appl. No. 12/203,698; 11 pages.
Gammack et al., Office Action mailed Sep. 17, 2012, directed to U.S. Appl. No. 13/114,707; 12 pages.
Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Gammack, P. et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.

(56) References Cited

OTHER PUBLICATIONS

Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Third Party Submission Under 37 CFR 1.99 filed Jun. 2, 2011, directed towards U.S. Appl. No. 12/203,698; 3 pages.
Simmonds et al., U.S. Office Action mailed Dec. 27, 2013, directed to U.S. Appl. No. 13/125,742; 18 pages.
Fitton et al., U.S. Office Action mailed Sep. 13, 2013, directed to U.S. Appl. No. 13/052,832; 13 pages.
Fitton et al., U.S. Office Action mailed Sep. 13, 2013, directed to U.S. Appl. No. 13/052,830; 10 pages.
GB Search Report dated May 20, 2010 directed to GB Application No. 1004813.0; 1 page.
GB Search Report dated May 20, 2010, directed to GB Application No. 1004812.2; 1 page.
GB Search Report dated May 20, 2010, directed to GB Patent Application No. 1004814.8 ; 1 page.
Reba, I., (Jun. 1966). "Applications of the Coanda Effect." Scientific American.214:84-92.
International Search Report and Written Opinion, mailed on Jun. 1, 2011, directed to International Patent Application No. PCT/GB2011/050427; 11 pages.
International Search Report and Written Opinion mailed Jul. 13, 2011, directed to International Application No. PCT/GB2011/050429; 11 pages.
International Search Report and Written Opinion mailed Jul. 15, 2011, directed to International Application No. PCT/GB2011/050428; 13 pages.
Fitton et al., U.S. Office Action mailed May 14, 2013, directed to U.S. Appl. No. 13/052,832; 15 pages.
Fitton et al., U.S. Office Action mailed May 15, 2013, directed to U.S. Appl. No. 13/052,830; 11 pages.
Fitton et al., U.S. Office Action mailed Oct. 26, 2012, directed to U.S. Appl. No. 13/052,832; 13 pages.
Fitton et al., U.S. Office Action mailed Nov. 15, 2012, directed to U.S. Appl. No. 13/052,830; 10 pages.

* cited by examiner

FAN

REFERENCE TO RELATED APPLICATIONS

This application claims the priority of United Kingdom Application No. 1004814.8 filed Mar. 23, 2010, the entire contents of which are incorporated herein by reference.

FIELD OF THE INVENTION

The present invention relates to a portable fan. Particularly, but not exclusively, the present invention relates to a floor or table-top fan, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

The use of fans in hospitals to keep patients cool is widespread, both in general wards and in isolation wards. For example, depending on the medical condition of the patient it may be preferable to reduce the body temperature of the patient using a fan rather than by using pharmaceuticals. When a fan is assigned to a patient, generally that fan is treated as an item of medical equipment and so, like other medical equipment, will require frequent cleaning by a nurse or other hospital employee. The cleaning of bladed fans can be time consuming for the employee, as the cage housing the blades of the fan needs to be disassembled before the blades of the fan can be cleaned. This disassembly usually requires the use of a screw driver, which cannot be carried by a nurse on a hospital ward. Often, it can be more convenient for the hospital to engage a specialist cleaning company to clean the fan off site, although this can be very expensive.

WO 2009/030879 describes a fan assembly which does not use caged blades to project air from the fan assembly. Instead, the fan assembly comprises a base which houses a motor-driven impeller for drawing a primary air flow into the base, and an annular nozzle connected to the base and comprising an annular slot through which the primary air flow is emitted from the fan. The nozzle defines a central opening through which air in the local environment of the fan assembly is drawn by the primary air flow emitted from the mouth, amplifying the primary air flow.

The time required to clean off the external surfaces of this type of "bladeless" fan is much shorter than that required to clean a fan having caged blades, as there is no requirement to dismantle any parts of the fan to access any exposed parts of the fan. For example, the external surfaces of the fan may be wiped clean using a cloth. While this level of cleaning may be sufficient for bladeless fans which are assigned to patients on general wards, when the bladeless fan is assigned to a patient in an isolation ward or infection containment ward there remains a need to keep the internal components of the base clean to avoid cross-contamination when the fan is assigned to another patient.

SUMMARY OF THE INVENTION

The present invention provides a portable fan comprising a casing having an air inlet and a first connector, and an air outlet comprising a second connector. A filter unit includes a third connector, which is substantially the same as the second connector, for co-operating with the first connector to removably connect the filter unit to the casing, a filter which is located upstream from the air inlet when the filter unit is connected to the casing, and a fourth connector, which is substantially the same as the first connector, for co-operating with the second connector to removably connect the air outlet to the filter unit.

This can allow the air outlet to be connected either directly to the casing, or for an optional filter unit to be connected between the casing and the air outlet. The type of connection made between the filter unit and the casing, and between the air outlet and the filter unit, is the same as the type of connection which is made between the air outlet and the casing in the absence of the filter unit. This facilitates the connection of the filter unit to the casing and the air outlet, as the technique for connecting the air outlet to the casing is the same as that for connecting the filter unit to the base, and for connecting the air outlet to the filter unit. The filter unit is preferably manually connected to the casing and the air outlet to allow a user to attach the filter unit to the fan, and subsequently detach the filter unit from the fan, without the need for a tool.

The filter unit is preferably in the form of a disposable filter unit which can be replaced when, for example, the fan is assigned to a different patient, when the fan is moved with the patient from an isolation ward to a general ward, or when the filter has reached the end of a prescribed usage period. This can significantly reduce the costs associated with the use of the fan, as the frequency with which the fan may need to be taken off site for cleaning can be significantly reduced.

The filter preferably comprises a high energy particle arrester (HEPA) filter. The filter may also comprise one or more of a foam, carbon, paper, or fabric filter. The filter preferably has a surface area in the range from 0.5 to 1.5 $m^2$ which is exposed to the air flow generated by the fan. To minimize the volume of the filter, the filter is preferably pleated to form a filter which is substantially annular in shape for surrounding the air inlet of the casing. In this case, the filter unit may comprise two annular discs between which the filter is located. These discs can be easily wiped clean during use of the fan. Each disc may comprise a raised rim extending towards the other disc for retaining the filter between the discs. The filter may be readily adhered to the discs during the construction of the filter unit. The discs may together be considered to form at least part of a filter unit to which the filter is adhered during construction of the filter unit.

The filter unit may comprise an outer cover comprising a plurality of apertures through which air enters the filter unit. This outer cover can provide a first, relatively coarse filter to prevent airborne objects such as insects or large particles of dust from coming into contact with the filter, and can prevent the filter from being contacted by a user, particularly during the attachment of the filter to the casing, and so prevent damage to the filter. The outer cover is preferably transparent to allow a user to see the amount of dust or debris which has been captured by the filter.

In a preferred embodiment the filter unit is in the form of a sleeve which is locatable about an external surface of a casing. The casing may be in the form of a base, which may be free-standing on a floor, desk, table or other surface.

The filter unit preferably comprises at least one seal for engaging an outer surface of the casing. This can ensure that the air flow generated by the fan passes through the filter to the air inlet, and not around the filter.

The air inlet may extend at least partially about the casing, and may comprise an array of apertures. For example, the casing may comprise a base surface and a side wall, with the air inlet being located in the side wall of the casing. The casing may be substantially cylindrical in shape. The casing may house means for generating an air flow from the air inlet to the air outlet. The means for generating the air flow preferably comprises an impeller driven by a motor. A diffuser is preferably located downstream from the impeller. The filter unit may comprise a first seal for engaging the casing of the fan, and a second seal for engaging the air outlet of the fan so that an air flow is drawn through the filter unit between the seals and through the filter.

The air outlet may comprise an interior passage for receiving an air flow and a mouth for emitting the air flow. The interior passage may extend about an opening through which air is drawn by the air flow emitted from the mouth.

The first and third connectors may comprise co-operating screw threads to allow the filter unit to be attached to, and subsequently detached from, the casing. Alternatively, the first connector may be arranged to releasably engage the third connector to inhibit rotation of the filter unit relative to the casing. The first connector is preferably in the form of, or comprises, a wedge. The third connector preferably comprises an inclined surface which is configured to slide over an inclined surface of the wedge as the filter unit is rotated relative to the casing to attach the filter unit to the casing. The third connector may also be in the form of a wedge. Opposing surfaces of the first and third connectors subsequently inhibit rotation of the fan unit relative to the casing during use of the fan to prevent the filter unit from becoming inadvertently detached from the casing. The first connector is preferably arranged to flex out of engagement with the third connector, for example due to the user applying a relatively large rotational force to the filter unit, to detach the filter unit from the casing. Thus assembly and disassembly can each be performed in one operation or twist movement, and could be performed by an unskilled user of the fan.

The first connector may be located on an outer surface of the casing, and the third connector may be located on an inner surface of the filter unit. The first connector may be located in a recessed portion of the outer surface of the casing. The filter unit may comprise a fifth connector, and the casing may comprise a sixth connector for co-operating with the fifth connector to inhibit movement of the filter unit away from the casing when the filter unit is connected to the casing by the first connector and the third connector. Similarly, the filter unit may comprise a seventh connector, and the air outlet may comprise an eighth connector for co-operating with the seventh connector to inhibit movement of the air outlet away from the filter unit when the air outlet is connected to the filter unit by the second connector and the fourth connector.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
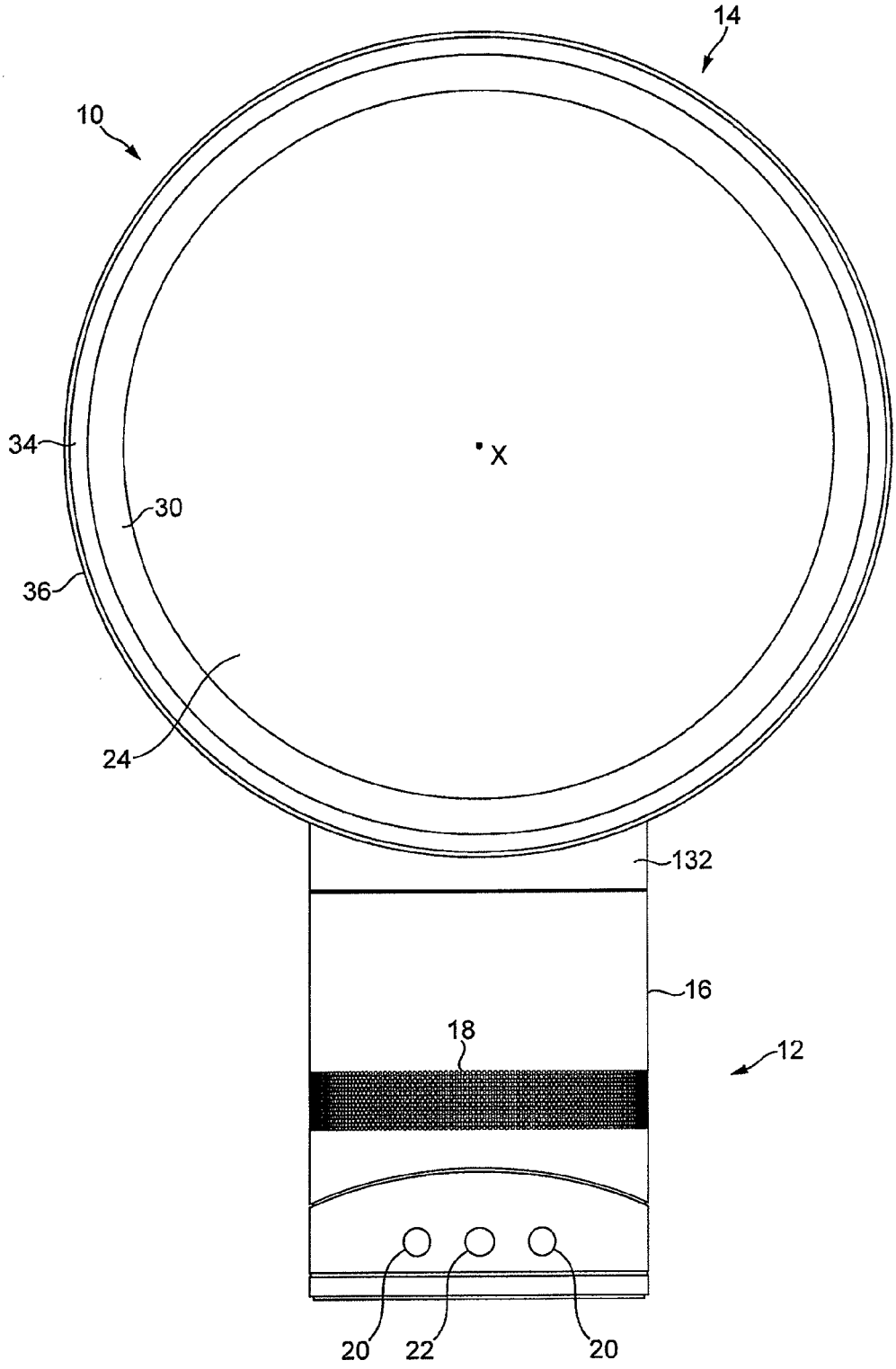
FIG. 1 is a front view of a fan.
Figure 2:
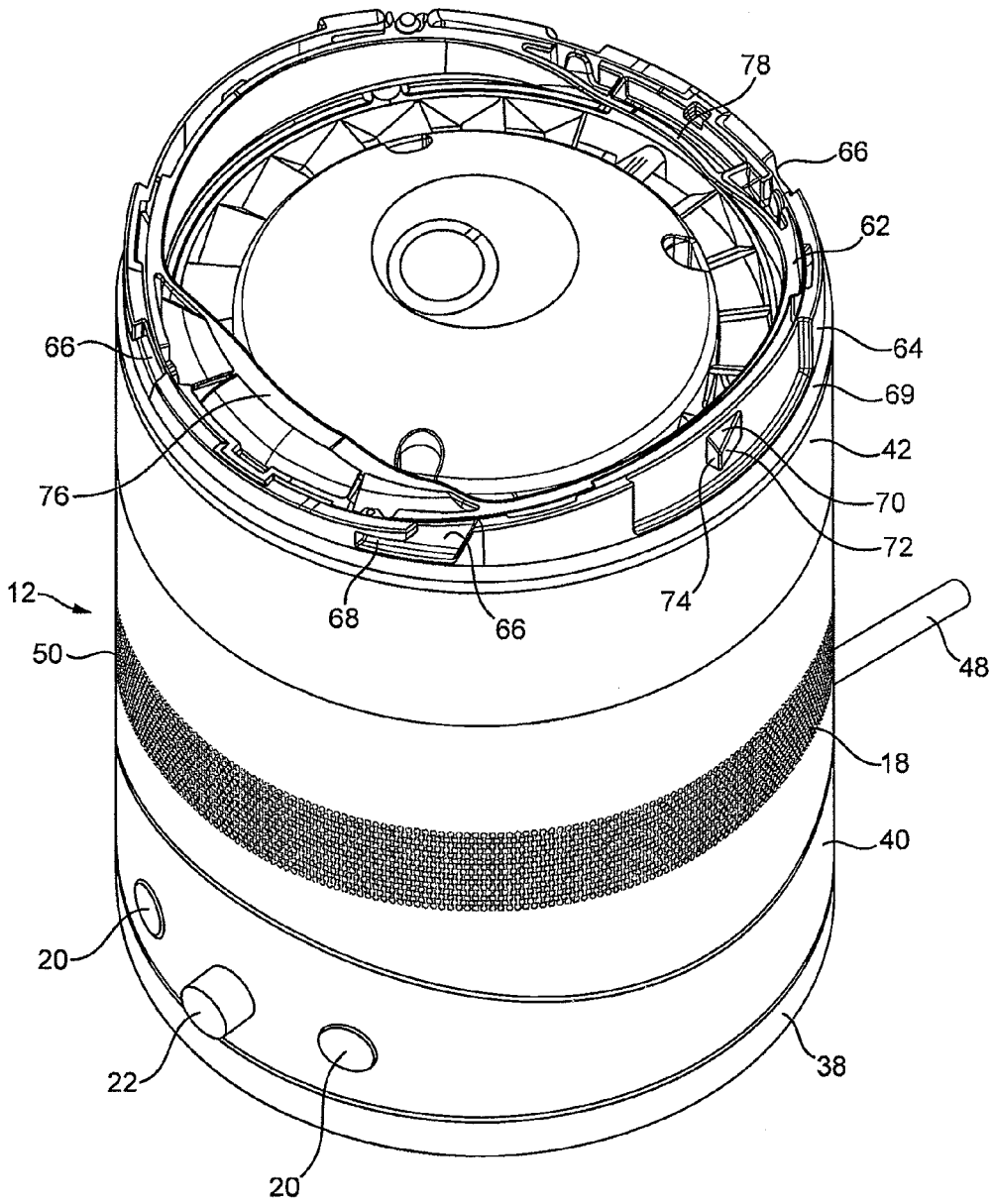
FIG. 2 is a perspective view of the base of the fan of FIG. 1.

FIG. 1 is a front view of a fan 10. The fan 10 is preferably in the form of a bladeless fan 10 comprising a base 12 and an air outlet 14 connected to the base 12. With reference also to FIG. 2, the base 12 comprises a substantially cylindrical outer casing 16 having a plurality of air inlets 18 in the form of apertures formed in the outer casing 16 and through which a primary air flow is drawn into the base 12 from the external environment. The base 12 further comprises a plurality of user-operable buttons 20 and a user-operable dial 22 for controlling the operation of the fan 10. In this example the base 12 has a height in the range from 200 to 300 mm, and the outer casing 16 has an external diameter in the range from 100 to 200 mm.

Figure 3:
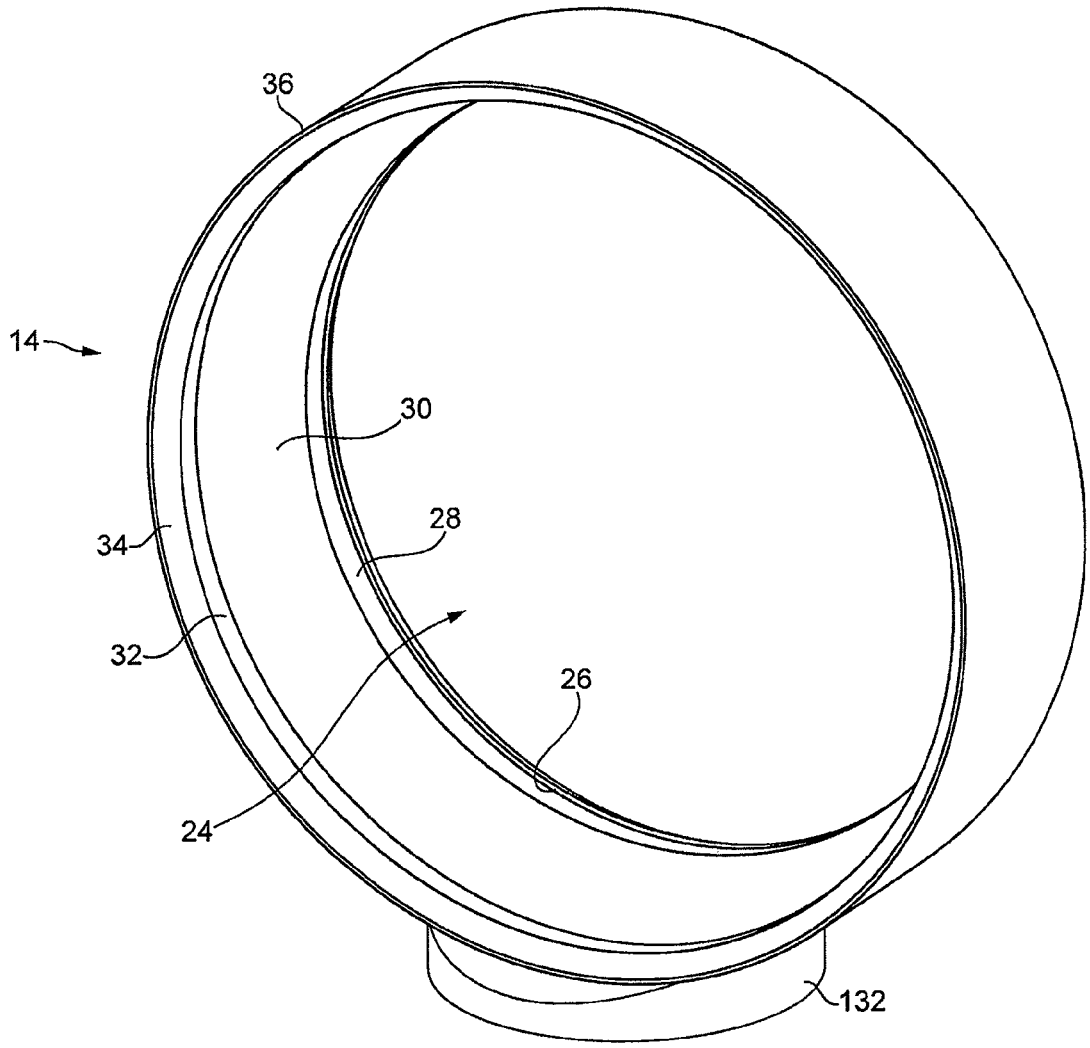
FIG. 3 is a perspective view of the air outlet of the fan of FIG. 1.

As shown in FIG. 3, the air outlet 14 has an annular shape and defines an opening 24. The air outlet 14 has a height in the range from 200 to 400 mm. The air outlet 14 comprises a mouth 26 located towards the rear of the fan 10 for emitting air from the fan 10 and through the opening 24. The mouth 26 extends at least partially about the opening 24, and preferably surrounds the opening 24. The inner periphery of the air outlet 14 comprises a Coanda surface 28 located adjacent the mouth 26 and over which the mouth 26 directs the air emitted from the fan 10, a diffuser surface 30 located downstream of the Coanda surface 28 and a guide surface 32 located downstream of the diffuser surface 30. The diffuser surface 30 is arranged to taper away from the central axis X of the opening 24 in such a way so as to assist the flow of air emitted from the fan 10. The angle subtended between the diffuser surface 30 and the central axis X of the opening 24 is in the range from 5 to 25°, and in this example is around 15°. The guide surface 32 is arranged at an angle to the diffuser surface 30 to further assist the efficient delivery of a cooling air flow from the fan 10. The guide surface 32 is preferably arranged substantially parallel to the central axis X of the opening 24 to present a substantially flat and substantially smooth face to the air flow emitted from the mouth 26. A visually appealing tapered surface 34 is located downstream from the guide surface 32, terminating at a tip surface 36 lying substantially perpendicular to the central axis X of the opening 24. The angle subtended between the tapered surface 34 and the central axis X of the opening 24 is preferably around 45°. The overall depth of the air outlet 14 in a direction extending along the central axis X of the opening 24 is in the range from 100 to 150 mm, and in this example is around 110 mm.

Figure 5:
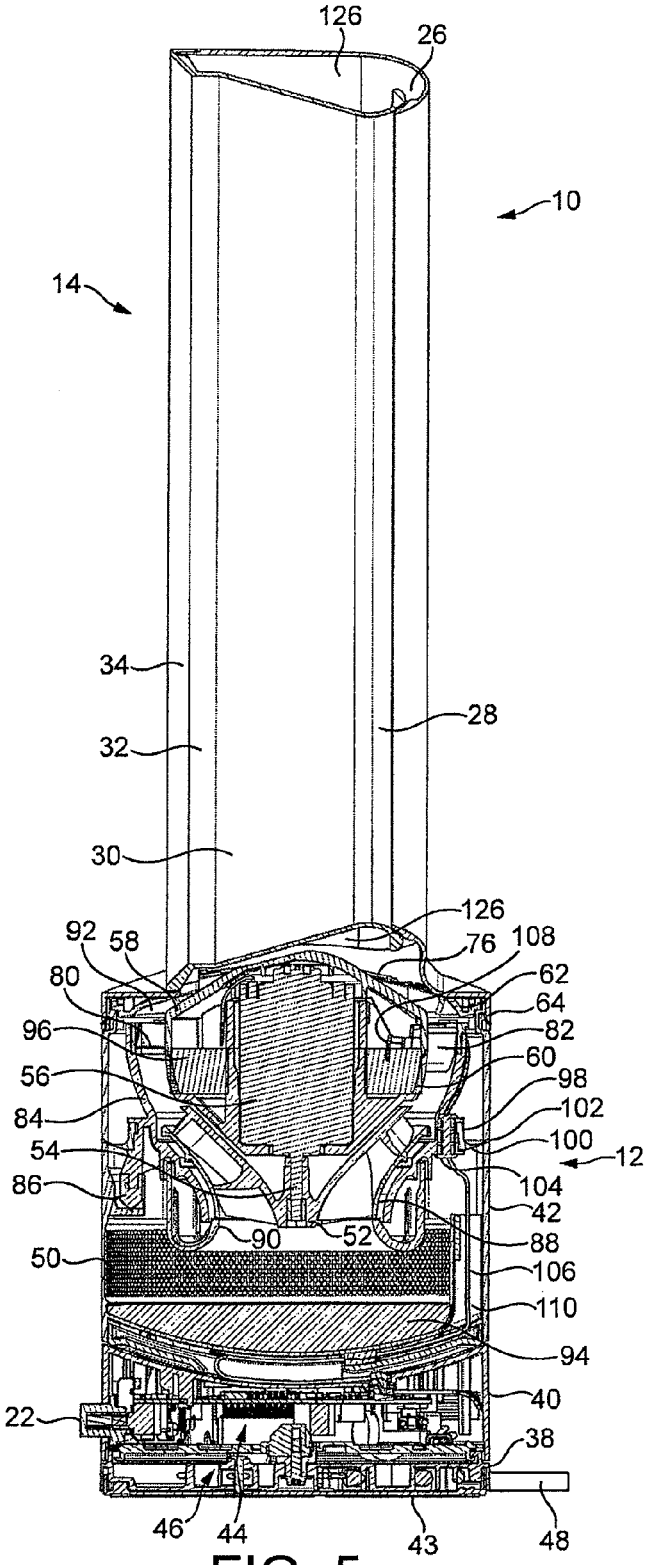
FIG. 5 is a sectional view of the fan of FIG. 1.

FIG. 5 illustrates a sectional view through the fan 10. The base 12 comprises a lower base member 38, an intermediary base member 40 mounted on the lower base member 38, and an upper base member 42 mounted on the intermediary base member 40. The lower base member 38 has a substantially flat bottom surface 43. The intermediary base member 40 houses a controller 44 for controlling the operation of the fan 10 in response to depression of the user operable buttons 20 shown in FIGS. 1 and 2, and/or manipulation of the user operable dial 22. The intermediary base member 40 may also house an oscillating mechanism 46 for oscillating the intermediary base member 40 and the upper base member 42 relative to the lower base member 38. The range of each oscillation cycle of the upper base member 42 is preferably between 60° and 120°, and in this example is around 90°. In this example, the oscillating mechanism 46 is arranged to perform around 3 to 5 oscillation cycles per minute. A mains power cable 48 extends through an aperture formed in the lower base member 38 for supplying electrical power to the fan 10.

The upper base member 42 may be tilted relative to the intermediary base member 40 to adjust the direction in which the primary air flow is emitted from the fan 10. For example, the upper surface of the intermediary base member 40 and the lower surface of the upper base member 42 may be provided with interconnecting features which allow the upper base member 42 to move relative to the intermediary base member 40 while preventing the upper base member 42 from being lifted from the intermediary base member 40. For example, the intermediary base member 40 and the upper base member 42 may comprise interlocking L-shaped members.

The upper base member 42 has an open upper end, and comprises an array of apertures 50 which extend at least partially about the upper base member 42. The apertures 50 provide the air inlet 18 of the base 12. The upper base member 42 houses an impeller 52 for drawing the primary air flow through the apertures 50 and into the base 12. Preferably, the impeller 52 is in the form of a mixed flow impeller. The impeller 52 is connected to a rotary shaft 54 extending outwardly from a motor 56. In this example, the motor 56 is a DC brushless motor having a speed which is variable by the controller 44 in response to user manipulation of the dial 22. The maximum speed of the motor 56 is preferably in the range from 5,000 to 10,000 rpm. The motor 56 is housed within a motor bucket comprising an upper portion 58 connected to a lower portion 60. The motor bucket is retained within the upper base member 42 by a motor bucket retainer 62. The upper end of the upper base member 42 comprises a cylindrical outer surface 64. The motor bucket retainer 62 is connected to the open upper end of the upper base member 42, for example by a snap-fit connection. The motor 56 and its motor bucket are not rigidly connected to the motor bucket retainer 62, allowing some movement of the motor 56 within the upper base member 42.

Returning to FIG. 2, the upper end of the upper base member 42 comprises two pairs of open grooves 66 formed by removing part of the outer surface 64 to leave a shaped 'cutaway' portion. The upper end of each of the grooves 66 is in open communication with the open upper end of the upper base member 42. The open groove 66 is arranged to extend downwardly from the open upper end of the upper base member 42. A lower part of the groove 66 comprises a circumferentially extending track 68 having upper and lower portions bounded by the outer surface 64 of the upper base member 42. Each pair of open grooves 66 is located symmetrically about the upper end of the upper base member 42, the pairs being spaced circumferentially from each other. An annular sealing member 69 extends about the outer surface of the upper base member 42, and is located beneath the tracks 68 of the grooves 66.

The cylindrical outer surface 64 of the upper end of the upper base member 42 further comprises a pair of wedge members 70 having a tapered part 72 and a side wall 74. The wedge members 70 are located on opposite sides of the upper base member 42, with each wedge member 70 being located within a respective cutaway portion of the outer surface 64.

The motor bucket retainer 62 comprises curved vane portions 76, 78 extending inwardly from the upper end of the motor bucket retainer 62. Each curved vane 76, 78 overlaps a part of the upper portion 58 of the motor bucket. Thus the motor bucket retainer 62 and the curved vanes 76, 78 act to secure and hold the motor bucket in place during movement and handling. In particular, the motor bucket retainer 62 prevents the motor bucket from becoming dislodged and falling towards the air outlet 14 if the fan 10 becomes inverted.

With reference again to FIG. 5, one of the upper portion 58 and the lower portion 60 of the motor bucket comprises a diffuser 80 in the form of a stationary disc having spiral fins 82, and which is located downstream from the impeller 52. One of the spiral fins 82 has a substantially inverted U-shaped cross-section when sectioned along a line passing vertically through the upper base member 42. This spiral fin 82 is shaped to enable a power connection cable to pass through the spiral fin 82 to the motor 56.

The motor bucket is located within, and mounted on, an impeller housing 84. The impeller housing 84 is, in turn, mounted on a plurality of angularly spaced supports 86, in this example three supports, located within the upper base member 42 of the base 12. A generally frusto-conical shroud 88 is located within the impeller housing 84. The shroud 88 is preferably connected to the outer edges of the impeller 52, and is shaped so that the outer surface of the shroud 88 is in close proximity to, but does not contact, the inner surface of the impeller housing 84. A substantially annular inlet member 90 is connected to the bottom of the impeller housing 84 for guiding the primary air flow into the impeller housing 84. The top of the impeller housing 84 comprises a substantially annular air outlet 92 for guiding air flow emitted from the impeller housing 84 towards the air outlet 14.

Preferably, the base 12 further comprises silencing members for reducing noise emissions from the base 12. In this example, the upper base member 42 of the base 12 comprises a disc-shaped foam member 94 located towards the base of the upper base member 42, and a substantially annular foam member 96 located within the impeller housing 84.

A flexible sealing member is mounted on the impeller housing 84. The flexible sealing member inhibits the return of air to the air inlet member 90 along a path extending between the outer casing 16 and the impeller housing 84 by separating the primary air flow drawn in from the external environment from the air flow emitted from the air outlet 92 of the impeller 52 and the diffuser 80. The sealing member preferably comprises a lip seal 98. The sealing member is annular in shape and surrounds the impeller housing 84, extending outwardly from the impeller housing 84 towards the outer casing 16. In the illustrated embodiment the diameter of the sealing member is greater than the radial distance from the impeller housing 84 to the outer casing 16. Thus the outer portion 100 of the sealing member is biased against the outer casing 16 and caused to extend along the inner face of the outer casing 16, forming a seal. The lip seal 98 of the preferred embodiment tapers and narrows to a tip 102 as it extends away from the impeller housing 84 and towards the outer casing 16. The lip seal 98 is preferably formed from rubber.

The sealing member further comprises a guide portion 104 for guiding a power connection cable 106 to the motor 56. The guide portion 104 of the illustrated embodiment is formed in the shape of a collar and may be a grommet. The electrical cable 106 is in the form of a ribbon cable attached to the motor at joint 108. The electrical cable 106 extending from the motor 56 passes out of the lower portion 60 of the motor bucket through spiral fin 82. The passage of the electrical cable 106 follows the shaping of the impeller housing 84 and the guide portion 104 is shaped to enable the electrical cable 106 to pass through the flexible sealing member. The guide portion 104 of the sealing member enables the electrical cable 106 to be clamped and held within the upper base member 42. A cuff 110 accommodates the electrical cable 106 within the lower portion of the upper base member 42.

Figure 6:
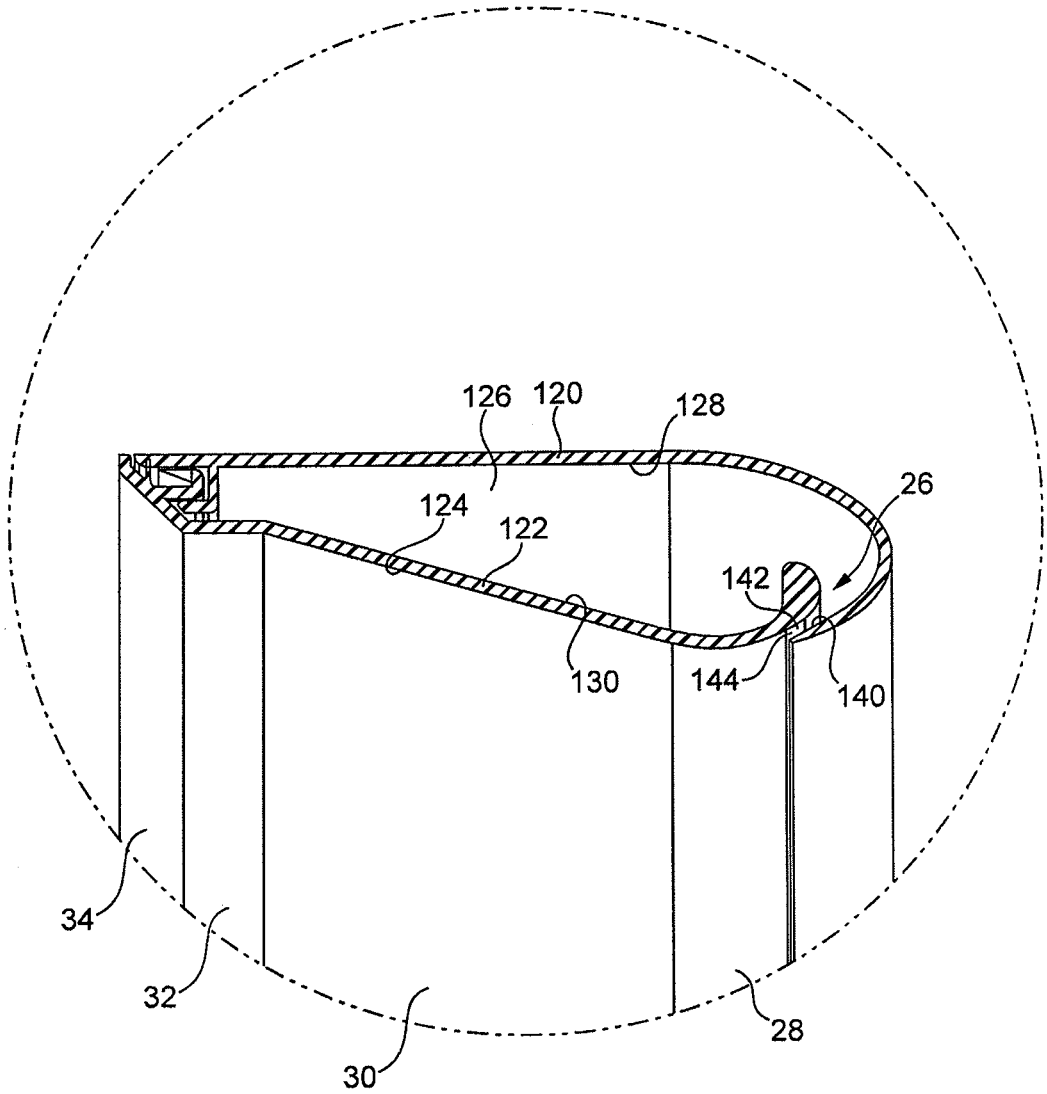
FIG. 6 is an enlarged view of part of FIG. 5.

FIG. 6 illustrates a sectional view through the air outlet 14. The air outlet 14 comprises an annular outer casing section 120 connected to and extending about an annular inner casing section 122. Each of these sections may be formed from a plurality of connected parts, but in this embodiment each of the outer casing section 120 and the inner casing section 122 is formed from a respective, single molded part. The inner casing section 122 defines the central opening 24 of the air outlet 14, and has an external peripheral surface 124 which is shaped to define the Coanda surface 28, diffuser surface 30, guide surface 32 and tapered surface 34.

Figure 4:
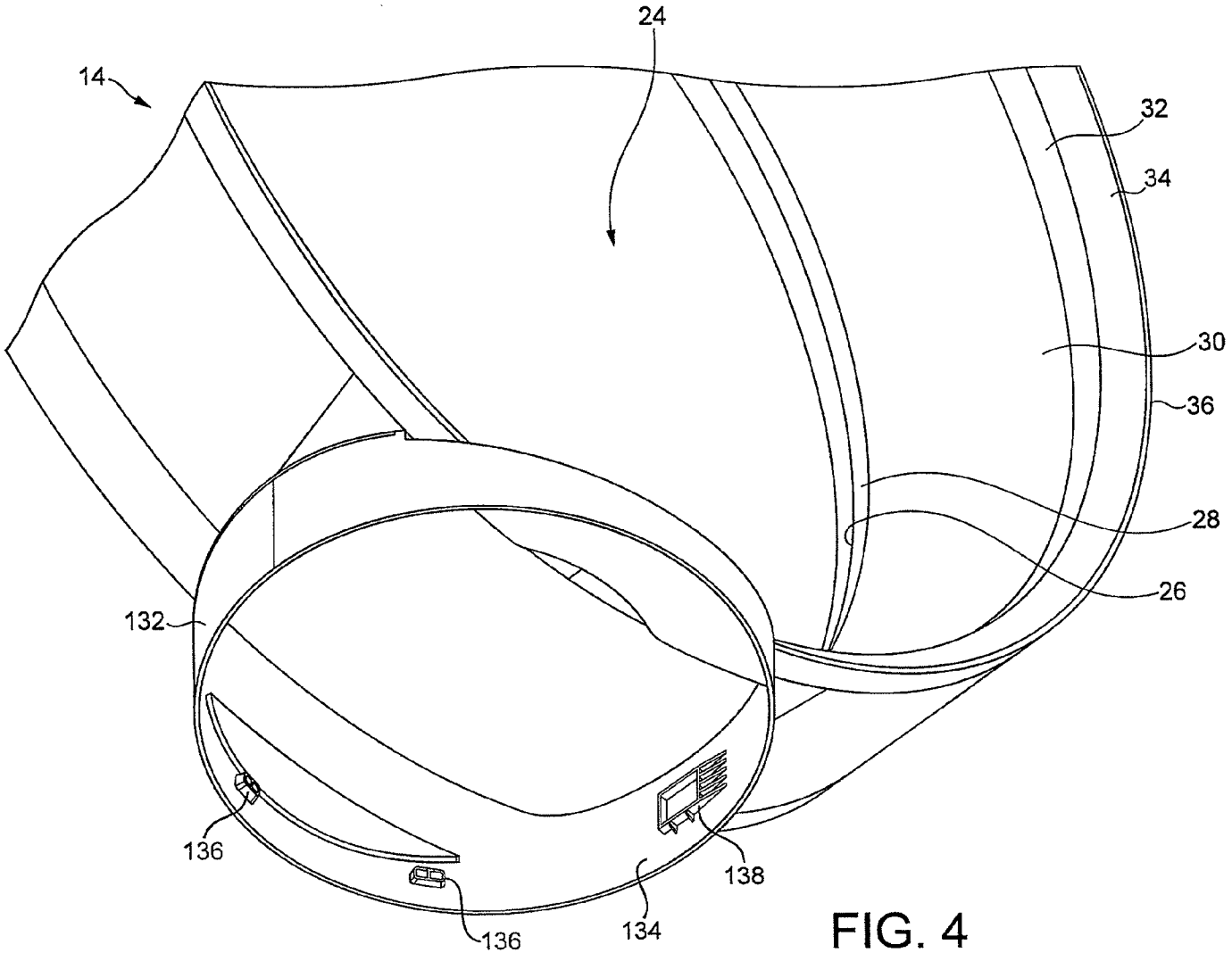
FIG. 4 is a lower perspective view of a portion of the air outlet of the fan of FIG. 1.

The outer casing section 120 and the inner casing section 122 together define an annular interior passage 126 of the air outlet 14. Thus, the interior passage 126 extends about the opening 24. The interior passage 126 is bounded by the internal peripheral surface 128 of the outer casing section 120 and the internal peripheral surface 130 of the inner casing section 122. As shown in FIG. 4, the outer casing section 120 comprises a base 132 having an inner surface 134. Formed on the inner surface 134 of the base 132 are two pairs of lugs 136 and a pair of ramps 138 for connection to the upper end of the upper base member 42. Each lug 136 and each ramp 138 upstands from the inner surface 134. Thus the base 132 is connected to, and over, the open upper end of the motor bucket retainer 62 and the upper base member 42 of the base 12. The pairs of lugs 136 are located around the outer casing section 120 and spaced from each other so that the pairs of lugs 136 correspond to the spaced arrangement of the pairs of open grooves 66 of the upper end of the upper base member 42 and so that the location of the pair of ramps 138 corresponds to the location of the pair of wedge members 70 of the upper end of the upper base member 42.

The base 132 of the outer casing section 120 comprises an aperture through which the primary air flow enters the interior passage 126 of the air outlet 14 from the upper end of the upper base member 42 and the open upper end of the motor bucket retainer 62.

The mouth 26 of the air outlet 14 is located towards the rear of the fan 10. The mouth 26 is defined by overlapping, or facing, portions 140, 142 of the internal peripheral surface 128 of the outer casing section 120 and the external peripheral surface 124 of the inner casing section 122, respectively. In this example, the mouth 26 is substantially annular and, as illustrated in FIG. 4, has a substantially U-shaped cross-section when sectioned along a line passing diametrically through the air outlet 14. In this example, the overlapping portions 140, 142 of the internal peripheral surface 128 of the outer casing section 120 and the external peripheral surface 124 of the inner casing section 122 are shaped so that the mouth 26 tapers towards an outlet 144 arranged to direct the primary flow over the Coanda surface 28. The outlet 144 is in the form of an annular slot, preferably having a relatively constant width in the range from 0.5 to 5 mm. In this example the outlet 144 has a width of around 1 mm. Spacers may be spaced about the mouth 26 for urging apart the overlapping portions 140, 142 of the internal peripheral surface 128 of the outer casing section 120 and the external peripheral surface 124 of the inner casing section 122 to maintain the width of the outlet 144 at the desired level. These spacers may be integral with either the internal peripheral surface 128 of the outer casing section 120 or the external peripheral surface 124 of the inner casing section 122.

Referring to FIGS. 3 and 4, to attach the air outlet 14 to the base 12, the air outlet 14 is inverted from the orientation illustrated in FIG. 4 and the base 132 of the air outlet 14 is located over the open upper end of the upper base member 42. The air outlet 14 is aligned relative to the base 12 so that the lugs 136 of the base 132 of the air outlet 14 are located directly in line with the open upper ends of the open grooves 66 of the upper base member 42. In this position the pair of ramps 138 of the base 132 is directly in line with the pair of wedge members 70 of the upper base member 42. The air outlet 14 is then pushed on to the base 12 so that the lugs 136 are located at the base of the open grooves 66. The sealing member 69 of the base 12 engages the inner surface 134 of the base 132 of the air outlet 14 to form an air-tight seal between the base 12 and the air outlet 14.

To secure the air outlet 14 to the base 12, the air outlet 14 is rotated in a clockwise direction relative to the base 12 so that the lugs 136 move along the circumferentially extending tracks 68 of the open grooves 66. The rotation of the air outlet 14 relative to the base 12 also forces the ramps 138 to run up and slide over the tapers 72 of the wedge member 70 through localized elastic deformation of the open upper end of the upper base member 42. With continued rotation of the air outlet 14 relative to the base 12, the ramps 138 are forced over the side walls 74 of the wedge members 70. The open upper end of the upper base member 42 relaxes so that the ramps 138 are generally radially aligned with the wedge members 70. Consequently, the side walls 74 of the wedge members 70 prevent accidental rotation of the air outlet 14 relative to the base 12, whereas the location the lugs 136 within the tracks 68 prevents lifting of the air outlet 14 away from the base 12. The rotation of the air outlet 14 relative to the base 12 does not require excessive rotational force and so the assembly of the fan 10 may be carried out by a user.

To operate the fan 10 the user depresses an appropriate one of the buttons 20 on the base 12, in response to which the controller 44 activates the motor 56 to rotate the impeller 52. The rotation of the impeller 52 causes a primary air flow to be drawn into the base 12 through the air inlet 18. Depending on the speed of the motor 56, the primary air flow generated by the impeller 52 may be between 20 and 30 liters per second. The pressure of the primary air flow at the outlet 92 of the base 12 may be at least 150 Pa, and is preferably in the range from 250 to 1.5 kPa. The primary air flow passes sequentially through the impeller housing 84, the upper end of the upper base member 42 and open upper end of the motor bucket retainer 62 to enter the interior passage 126 of the air outlet 14. The primary air flow emitted from the air outlet 92 of the base 12 is generally in an upward and forward direction.

Within the air outlet 14, the primary air flow is divided into two air streams which pass in opposite directions around the central opening 24 of the air outlet 14. Part of the primary air flow entering the air outlet 14 in a sideways direction (generally orthogonal to the axis X) passes into the interior passage 126 in a sideways direction without significant guidance, whereas another part of the primary air flow entering the air outlet 14 in a direction parallel to the axis X is guided by the curved vanes 76, 78 of the motor bucket retainer 62 to enable the air flow to pass into the interior passage 126 in a sideways direction. As the air streams pass through the interior passage 126, air enters the mouth 26 of the air outlet 14. The air flow into the mouth 26 is preferably substantially even about the opening 24 of the air outlet 14. Within each section of the mouth 26, the flow direction of the portion of the air stream is substantially reversed. The portion of the air stream is constricted by the tapering section of the mouth 26 and emitted through the outlet 98.

The primary air flow emitted from the mouth 26 is directed over the Coanda surface 28 of the air outlet 14, causing a secondary air flow to be generated by the entrainment of air from the external environment, specifically from the region around the outlet 98 of the mouth 26 and from around the rear of the air outlet 14. This secondary air flow passes through the central opening 24 of the air outlet 14, where it combines with the primary air flow to produce a total air flow, or air current, projected forward from the air outlet 14. Depending on the speed of the motor 56, the mass flow rate of the air current projected forward from the fan 10 may be in the range from 300 to 400 liters per second, and the maximum speed of the air current may be in the range from 2.5 to 4 m/s.

The even distribution of the primary air flow along the mouth 26 of the air outlet 14 ensures that the air flow passes evenly over the diffuser surface 30. The diffuser surface 30 causes the mean speed of the air flow to be reduced by moving the air flow through a region of controlled expansion. The relatively shallow angle of the diffuser surface 30 to the axis X of the opening 24 allows the expansion of the air flow to occur gradually. A harsh or rapid divergence would otherwise cause the air flow to become disrupted, generating vortices in the expansion region. Such vortices can lead to an increase in turbulence and associated noise in the air flow which can be undesirable, particularly in a domestic product such as a fan. The air flow projected forwards beyond the diffuser surface 30 can tend to continue to diverge. The guide surface 32 extending inwardly towards the axis X converges the air flow towards the axis X. As a result, the air flow can travel efficiently out from the air outlet 14, enabling rapid air flow to be experienced at a distance of several meters from the fan 10.

Figure 7:
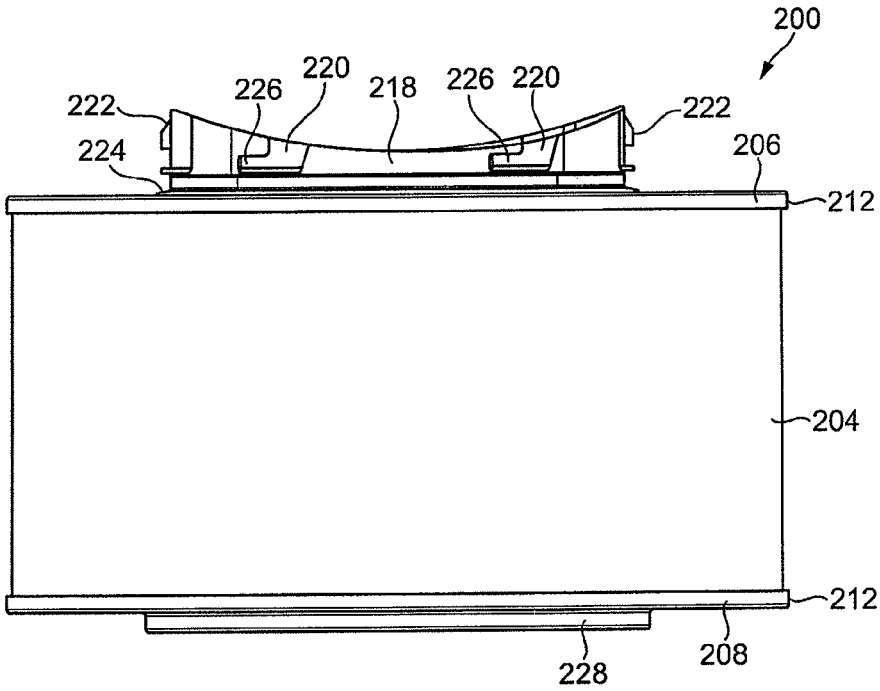
FIG. 7 is a side view of an accessory for attachment to the fan of FIG. 1.
Figure 8:
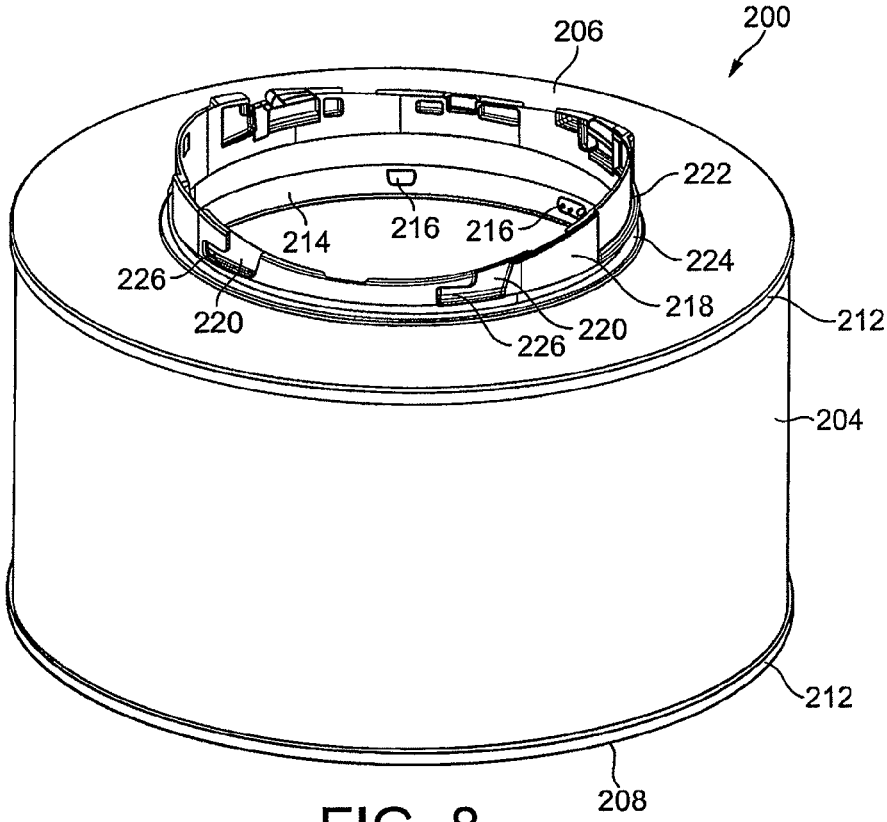
FIG. 8 is a perspective view, from above, of the accessory of FIG. 7.
Figure 9:
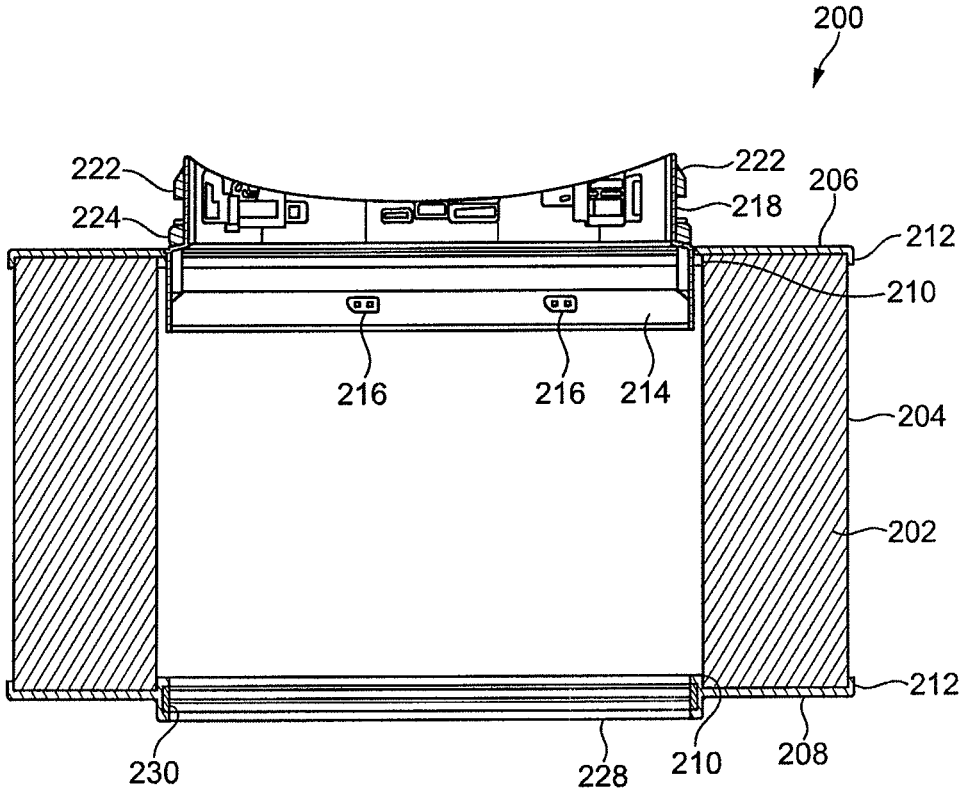
FIG. 9 is a sectional view of the accessory of FIG. 7.

FIGS. 7 to 9 illustrate an external accessory for the fan 10. The accessory is in the form of a filter unit 200 which is detachably attachable to the fan 10 to allow the filter unit 200 to be removed for cleaning or replacement.

Figure 10:
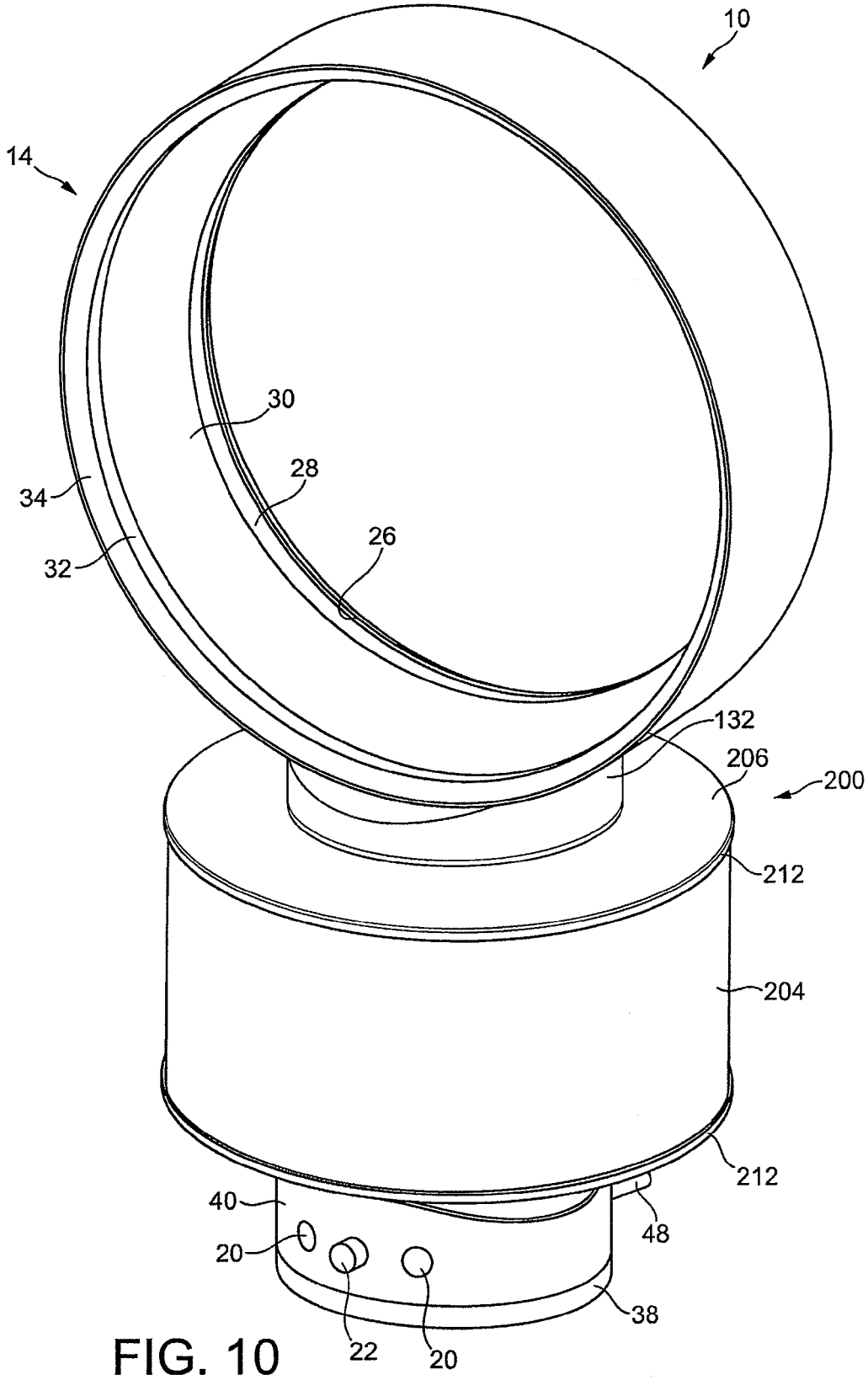
FIG. 10 is a perspective view of the fan of FIG. 1 with the accessory of FIG. 7 attached thereto.
Figure 11:
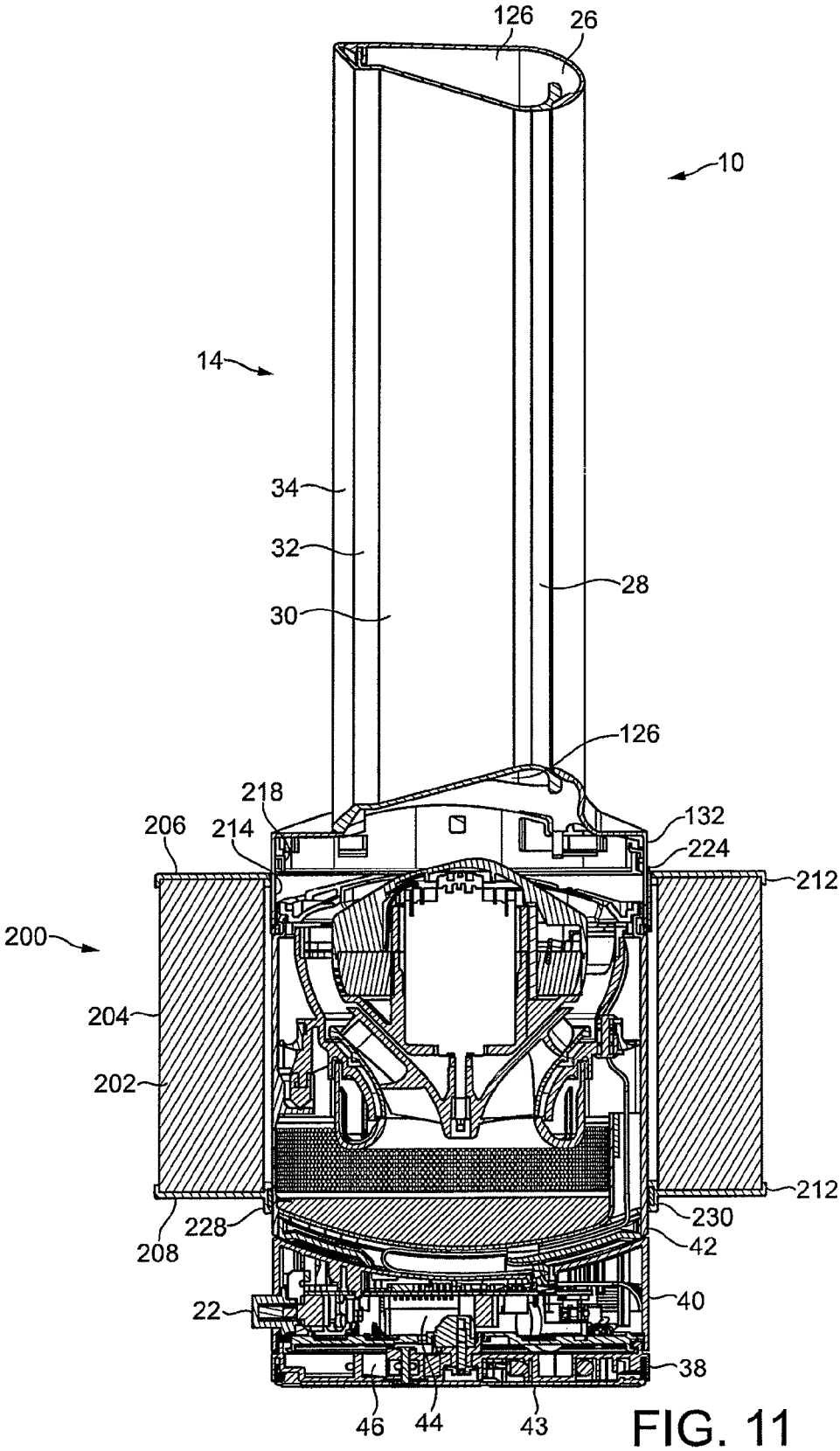
FIG. 11 is a sectional view of the fan of FIG. 10.

The filter unit 200 is in the form of a generally cylindrical sleeve which is locatable around the upper base member 42 of the base 12 so that the filter unit 200 is located over the air inlet 18 of the fan 10, as illustrated in FIGS. 10 and 11. This allows the filter unit 200 to remove airborne particles from the primary air flow generated by the fan 10 before the primary air flow enters the base 12 of the fan 10.

The filter unit 200 comprises a generally annular filter 202 for removing airborne particles from the primary air flow. The filter 202 is preferably in the form of a radially pleated high energy particle arrester (HEPA) filter. The filter 202 has a surface area that is exposed to the incoming primary air flow generated by the fan which is in the range from 0.5 to 1.5 $m^2$, and in this example is around 1.1 $m^2$. The filter 202 is surrounded by a cylindrical outer cover 204, which is preferably formed from plastics material, to protect the filter 202 and thus allows a user to handle the filter unit 200 without contacting the filter 202. The cover 204 is preferably transparent to allow a user to examine visually the state of the filter 202 during use or after a period of use. The cover 204 comprises a plurality of apertures (not shown) through which the primary air flow enters the filter unit 200, and thus provides a relatively coarse first stage of filtration of the filter unit 200 to prevent relatively large airborne objects or insects from entering the filter unit 200. The filter unit 200 may further comprise additional filter media between the filter 202 and the cover 204, or downstream from the filter 202. For example, this additional filter media may comprise one or more of foam, carbon, paper, or fabric.

The filter 202 and the cover 204 are sandwiched between two annular plates 206, 208 of the filter unit 200. Each plate 206, 208 includes a circular inner rim 210 and a circular outer rim 212 which both extend partially towards the other plate 206, 208. The filter 202 and the cover 204 are located between the rims 210, 212 of the plates 206, 208, and are preferably secured to the plates 206, 208 using an adhesive.

The upper plate 206 comprises a lower collar 214 which is located radially inwardly from the inner rim 210 of the upper plate 206. The lower collar 214 extends axially downwards from the upper plate 206. The inner diameter of the lower collar 214 is substantially the same as the inner diameter of the base 132 of the air outlet 14 of the fan 10. Similar to the base 132 of the air outlet 14, the inner surface of the lower collar 214 comprises two pairs of lugs 216 and a pair of ramps (not shown) for connection to the upper end of the upper base member 42 of the base 12 of the fan 10. The shape of the lugs 216 and the ramps of the lower collar 214, and the angular spacing between the lugs 216 and the ramps of the lower collar 214, are substantially identical to those of the lugs 136 and ramps 138 of the base 132 of the air outlet 14.

The upper plate 206 further comprises an upper collar 218 which is located radially inwardly from the lower collar 214. The upper collar 218 extends axially upwards from the inner circumferential periphery of the upper plate 208. The outer diameter of the upper collar 218 is substantially the same as the outer diameter of the outer surface 64 of the open upper end of the upper base member 42. Similar to the upper base member 42, the upper collar 218 comprises two pairs of open grooves 220 and a pair of wedge members 222. The open grooves 220 are substantially identical to the open grooves 66 of the outer surface 64 of the upper base member 42, and the spacing between the open grooves 220 is substantially the same as that between the open grooves 66. The wedge members 222 are substantially identical to the wedge members 70 of the outer surface 64 of the upper base member 42, and the spacing between the wedge members 222 is substantially the same as that between the wedge members 70. A first annular sealing member 224 of the filter unit 200 extends about the outer surface of the upper collar 218, and is located beneath the circumferentially extending tracks 226 of the grooves 220.

The collars 214, 218 are preferably integral with the upper plate 206, which is preferably formed from plastics material.

The lower plate 208 includes a relatively small collar 228 which extends axially downwardly from the inner rim 210 of the lower plate 208. The collar 228 comprises a circumferentially extending groove located on its inner surface. A second annular sealing member 230 of the filter unit 200 is located within this groove. The collar 228 is preferably integral with the lower plate 208, which is also preferably formed from a plastics material.

To attach the filter unit 200 to the fan 10, first the air outlet 14 is detached from the base 12. To detach the air outlet 14 from the base 12, the air outlet 14 is twisted relative to the base 12 in the opposite direction (anti-clockwise) to that for attaching the air outlet 14 to the base 12. With a suitable torque applied manually by the user, the upper end of the upper base member 42 is again caused to flex locally radially inwardly. This localized deformation of the upper base member 42 allows the ramp 138 to be rotated over the wedge members 70, while the lugs 136 are moved simultaneously along the tracks 68 of the grooves 66. Once the lugs 136 reach the ends of the tracks 68, the air outlet 14 may be lifted from the base 12.

Although the detachment of the air outlet 14 from the base 12 requires a greater force to be applied to the air outlet 14 than the force required for attachment, the resilience of the upper base member 42 is selected so that the detachment of the air outlet 14 may be performed manually The user then attaches the filter unit 200 to the base 12. The technique for attaching the filter unit 200 to the base 12 is essentially the same as that for attaching the air outlet 14 to the base 12. The user locates the open lower end of the collar 228 of the lower plate 208 over the open upper end of the upper base member 42, and lowers the filter unit 200 around the base 12. When the bottom end of the lower collar 214 of the upper plate 206 is located immediately above the open upper end of the upper base member 42, the user rotates the filter unit 200 until the lugs 216 of the filter unit 200 are located directly in line with the open upper end of the open grooves 66 of the upper base member 42. In this position the pair of ramps of the filter unit is directly in line with the pair of wedge members 70 of the upper base member 42. The filter unit 200 is then pushed further on to the base 12 so that the lugs 216 of the filter unit 200 are located at the base of the open grooves 66 of the base 12. To secure the filter unit 200 to the base 12, the filter unit 200 is rotated in a clockwise direction relative to the base 12 so that the lugs 216 move along the circumferentially extending tracks 68 of the open grooves 66. The rotation of the filter unit 200 relative to the base 12 also forces the ramps to run up and slide over the tapers 72 of the wedge members 70 through localized elastic deformation of the upper base member 42. With continued rotation of the filter unit 200 relative to the base 12, the ramps are forced over the side walls 74 of the wedge members 70. The upper base member 42 relaxes so that the ramps are generally radially aligned with the wedge members 70. Consequently, the side walls 74 of the wedge members 70 prevent accidental rotation of the filter unit 200 relative to the base 12, whereas the location the lugs 216 within the tracks 68 prevents lifting of the filter unit 200 away from the base 12.

As shown in FIG. 11, when the filter unit 200 is attached to the base 12 the second sealing member 230 of the filter unit 200 is located beneath the air inlet 18 of the base 12, and engages the outer surface of the base 12 to form an air-tight seal between the base 12 and the filter unit 200. As also shown in FIG. 10, the buttons 22 and user operable dial 22 of the base 12 remain accessible by the user when the filter unit 200 is attached to the base 12.

The air outlet 14 is then attached to the filter unit 200. The attachment of the air outlet 14 to the filter unit 200 is essentially the same as the attachment of the air outlet 14 to the base 12. The base 132 of the air outlet 14 is located over the upper collar 218 of the filter unit 200, and the air outlet 14 is aligned relative to the base 12 so that the lugs 136 of the base 132 of the air outlet 14 are located directly in line with the open upper end of the open grooves 220 of the filter unit 200. The air outlet 14 is then pushed on to the filter unit 200 so that the lugs 136 are located at the base of the open grooves 220. The first sealing member 224 of the filter unit 200 engages the inner surface 134 of the base 132 of the air outlet 14 to form an air-tight seal between the filter unit 200 and the air outlet 14. Again, to secure the air outlet 14 to the filter unit 200 the air outlet 14 is rotated in a clockwise direction relative to the filter unit 200 so that the lugs 136 move along the circumferentially extending tracks 226 of the open grooves 220 of the filter unit 200. The rotation of the air outlet 14 relative to the filter unit 200 also forces the ramps 138 to run up and slide over the tapers of the wedge members 222 of the filter unit 200 through localized elastic deformation of the upper collar 218. With continued rotation of the air outlet 14 relative to the filter unit 200, the ramps 138 are forced over the side walls of the wedge members 222. The upper collar 218 relaxes so that the ramps 138 are generally radially aligned with the wedge members 222. Consequently, the side walls of the wedge members 222 prevent accidental rotation of the air outlet 14 relative to the filter unit 200, whereas the location the lugs 136 within the tracks 226 of the grooves 200 prevents lifting of the air outlet 14 away from the filter unit 200.

The assembled combination of the fan 10 and the filter unit 200 is shown in FIGS. 10 and 11. The air-tight seals that the filter unit 200 makes with the base 12 and the air outlet 14 force the primary air flow to pass through the filter 202 of the filter unit 200 to remove airborne particulates from the primary air flow before it enters the base 12. In addition to purifying the air in the local environment of the fan 10, the removal of airborne particulates from the primary air flow before it enters the base 12 can significantly reduce the rate at which dust and debris can build-up on the internal components of the fan 10, thereby reducing the frequency at which the fan 10 needs to be cleaned. The filter unit 200 may be easily replaced for cleaning or replacement by detaching the air outlet 14 from the filter unit 200, which is performed in the same manner as the removal of the air outlet 14 from the base 12, and subsequently detaching the filter unit 200 from the base 12. This can be performed quickly and easily without the use of any tools. When the use of the filter unit 200 is no longer required, the filter unit 200 can be rapidly removed from the fan 10 by detaching the filter unit 200 from the base 12, and re-attaching the air outlet 14 directly to the base 12.

The invention claimed is:

1. A portable fan comprising:

a casing having an air inlet and a first connector;

an air outlet comprising a second connector; and a filter unit comprising a third connector, which is substantially the same as the second connector, for co-operating with the first connector to removably fasten the filter unit to the casing, a filter which is located upstream from the air inlet when the filter unit is connected to the casing, and a fourth connector, which is substantially the same as the first connector, for co-operating with the second connector to removably fasten the air outlet to the filter unit.

2. The fan of claim 1, wherein the first connector is arranged to engage the third connector to inhibit rotation of the filter unit relative to the casing.

3. The fan of claim 2, wherein the first connector is arranged to flex out of engagement with the third connector in dependence on the magnitude of a force which is applied to the third connector to rotate the filter unit relative to the casing.

4. The fan of claim 2, wherein the first connector is in the shape of a wedge.

5. The fan of claim 4, wherein the third connector is in the shape of a wedge.

6. The fan of claim 2, wherein the first connector is located on an outer surface of the casing, and the third connector is located on an inner surface of the filter unit.

7. The fan of claim 6, wherein the first connector is located in a recessed portion of the outer surface of the casing.

8. The fan of claim 7, wherein the filter unit comprises a fifth connector, and the casing comprises a sixth connector for co-operating with the fifth connector to inhibit movement of the filter unit away from the casing when the filter unit is connected to the casing by the first connector and the third connector.

9. The fan of claim 8, wherein the filter unit comprises a seventh connector, and the air outlet comprises an eighth connector for co-operating with the seventh connector to inhibit movement of the air outlet away from the filter unit when the air outlet is connected to the filter unit by the second connector and the fourth connector.

10. The fan of claim 1, wherein the filter unit comprises at least one seal for engaging an outer surface of the casing.

11. The fan of claim 1, wherein the filter extends about the casing when the filter unit is connected to the casing.

12. The fan of claim 1, wherein the filter is substantially annular in shape.

13. The fan of claim 12, wherein the filter unit comprises two annular discs between which the filter is located.

14. The fan of claim 13, wherein each disc comprises a raised rim extending towards the other disc for retaining the filter between the discs.

15. The fan of claim 13, wherein the filter is adhered to the discs.

16. The fan of claim 1, wherein the filter unit comprises a filter housing, and the filter is adhered to the filter housing.

17. The fan of claim 1, wherein the filter unit comprises an outer cover comprising a plurality of apertures.

18. The fan of claim 1, wherein the casing houses an impeller and a motor for rotating the impeller for generating an air flow from the air inlet to the air outlet.

19. The fan of claim 1, wherein the casing comprises a base surface and a side wall, and wherein the air inlet is located in the side wall of the casing.

20. The fan of claim 1, wherein the air inlet extends at least partially about the casing.

21. The fan of claim 1, wherein the air inlet comprises an array of apertures.

22. The fan of claim 1, wherein the casing is substantially cylindrical in shape.

23. The fan of claim 1, wherein the filter unit comprises a first seal for engaging the casing, and a second seal for engaging the air outlet.

24. The fan of claim 1, wherein the air outlet comprises an interior passage for receiving an air flow from the casing, and a mouth for emitting the air flow.

25. The fan of claim 24, wherein the interior passage extends about an opening through which air is drawn by the air flow emitted from the mouth.

* * * * *